US005511473A

United States Patent [19]

Ohmi et al.

[11] Patent Number: 5,511,473

[45] Date of Patent: Apr. 30, 1996

[54] WIDTH ADJUSTING DEVICE FOR A PAPER WEB

[75] Inventors: Takashi Ohmi, Yokohama; Yasuo Shibuya, Kodaira, both of Japan

[73] Assignee: Kabushikigaisha Tokyo Kikai Seisakusho, Tokyo, Japan

[21] Appl. No.: 417,729

[22] Filed: Apr. 6, 1995

Related U.S. Application Data

[63] Continuation of Ser. No. 200,390, Feb. 23, 1994, abandoned.

[30] Foreign Application Priority Data

Mar. 19, 1993 [JP] Japan ..... 5-085285

[51] Int. Cl.[6] ..... B41F 13/54

[52] U.S. Cl. ..... 101/228; 101/425

[58] Field of Search ..... 101/177, 180, 101/181, 183, 219, 228, 425

[56] References Cited

U.S. PATENT DOCUMENTS

| | | | |
|---|---|---|---|
| 3,098,432 | 7/1963 | Bechtold et al. | 101/152 |
| 3,147,898 | 9/1964 | Huck | 266/17 |
| 3,467,008 | 9/1969 | Domotor | 101/425 |
| 3,982,327 | 9/1976 | Kurie et al. | 34/156 |
| 4,303,189 | 12/1981 | Wiley et al. | 226/15 |
| 4,696,230 | 9/1987 | Barkley | 101/181 |
| 4,831,926 | 5/1989 | Bowman et al. | 101/138 |
| 5,152,222 | 10/1992 | Okamura et al. | 101/211 |
| 5,152,522 | 10/1992 | Yamashita | 271/264 |
| 5,197,385 | 3/1993 | Burger | 101/177 |
| 5,285,726 | 2/1994 | Ohta | 101/228 |

FOREIGN PATENT DOCUMENTS

| | | |
|---|---|---|
| 3-357580 | 12/1991 | Japan . |
| 4-309476 | 10/1992 | Japan . |

OTHER PUBLICATIONS

Laubscher, H., "Stacked Modular Press Configurations or Satellites–A Systematic Comparison", *INFA Newspaper Techniques English Edition,* Apr. 1988, pp. 64–73.

*Primary Examiner*—Ren Yan
*Attorney, Agent, or Firm*—Foley & Lardner

[57] ABSTRACT

An improved width adjusting device for a paper web which can assure the printing apparatus is free from trouble caused by stored paper dust and gathered ink, includes at least one pressure force applying device with respect to at least one side surface of the paper web travelling through at least one of the printing sections, and at least one drive control device for making the pressure force applying device move in a different direction and/or at a different speed from that of the travelling paper web.

9 Claims, 10 Drawing Sheets

WIDTH ADJUSTING DEVICE FOR A PAPER WEB

This application is a continuation of application Ser. No. 08/200,390, filed Feb. 23, 1994, now abandoned.

BACKGROUND OF THE INVENTION

1. Field of the Invention

The present invention generally relates to a width adjusting device adapted for a rotary lithographic press which is equipped with a plurality of printing sections. More particularly, the present invention relates to an improved width adjusting device which adjusts the width of the paper web printed by at least the first printing section.

2. Description of the Related Art

In commonly used rotary lithographic printing systems employing dampening water, a paper web is supplied with such dampening water when the paper web is passed through a printing section. Since most of the pulp fibers of the paper web are orientated in the longitudinal direction of the paper web, the pulp fibers are expanded laterally due to the dampening water. As a result, the paper web will be remarkably extended in its width direction after the printing section.

A typical rotary lithographic printing system TP as shown in FIG. 10 includes vertically arranged printing sections, so that the former printed image and lines by the preceding printing section and the later printed image and line by the succeeding printing section are often sheared owing to the swell of the paper web W. Accordingly, this will produce printed materials with poor quality.

Therefore, the inventor of this application has submitted two inventions as Japanese Patent Application No. 3-357580/1992 and 4-309476/1992 to prevent the printed images from shearing. These inventions disclose similar systems to apply any pressure onto a running paper web and form wave in the lateral direction of the paper web. The lateral wave may cancel the extended dimension in the lateral direction of the paper web. Such wave forming devices are arranged between the preceding and succeeding printing sections so as to fit the image and lines printed by the preceding printing section with that by the succeeding printing section.

However, since the wave forming devices employ contact members such as roller, knaggy rod, and the like to apply the contact pressure onto the web surface, such contact members may cause the printing quality of the printed image to be poor. In detail, when the contact members are moved (rotated) at the same speed of the paper web, printing ink and paper dusts are stored on the contact surface of the contact members. The stored ink and paper dusts may cause various damages in printed images, blanket cylinders, plate cylinders, and inking systems. On the other hand, when the contact members are stationarily arranged, printing ink and paper dusts are remained and stored in the downstream area of the contact members. The stored ink and paper dusts may gradually grow longer in the paper running direction, and finally cause various troubles in the printing plate, blanket cylinder and inking system of this printing apparatus resulting in spoiling printed matters.

BRIEF SUMMARY OF THE INVENTION

Therefore, it is a primary object of the invention to provide an improved width adjusting device for a paper web, which can be associated with a lithographic color-printing system including at least two printing sections using dampening means to successively print image and lines on the same paper web, and which can adjust the width of the paper web to correctly accord the former printed image with the secceeding printing image.

Another object of the present invention is to provide an improved width adjusting device for a paper Web to produce printed matters with a fine and sharp printed image.

Further object of the present invention is to provide an improved width adjusting device for a paper web which can assure the printing apparatus free from troubles caused by stored paper dusts and gathered ink.

To accomplish the above described objects, a web width adjusting device according to the present invention comprises at least one of pressure force applying means with respect to at least one side surface of a paper web travelling through at least one of printing sections and at least one of drive control means for making the pressure force applying means move in the different direction and/or at the different speed from the paper web travelling.

In the width adjusting device according to the present invention, the contact position between the pressure force applying means and the paper web is periodically or randomly varied by the drive control means and/or the drive-speed of the pressure force applying means is forcibly varied with respect to the travelling speed of the paper web. This drive control means prevents the contact position between the pressure force applying means and the paper web from storing with paper dusts and ink. Thus the printed image can be kept clear without any spoilages owing to the paper dusts and ink stored.

Other objects and features of the invention will apparent from a reading of the following description of the disclosure found in the accompanying drawings and the novelty thereof pointed out in the appended claims.

DETAILED DESCRIPTION OF THE PREFERRED EMBODIMENT

Preferred embodiments of the present invention will be described in detail with referring to the accompanying drawings.

FIG. 1 to FIG. 4 are perspective views showing first to fourth embodiments wherein a pressure force applying means 1 are arranged at one side of a paper web W. FIG. 5 to FIG. 9 are also perspective views showing fifth to nineth enbodiments wherein two sets of the pressure force applying means 1 are arranged at both sides of a paper web W. Through FIG. 1 to FIG. 9, the same or corresponding elements or parts having the similar function with each other are represented by the same numerals or characters, for example a paper web W and printng section P. Therefore the same explanation will not be repeated in order to avoid complicated understanding.

Figure 1:
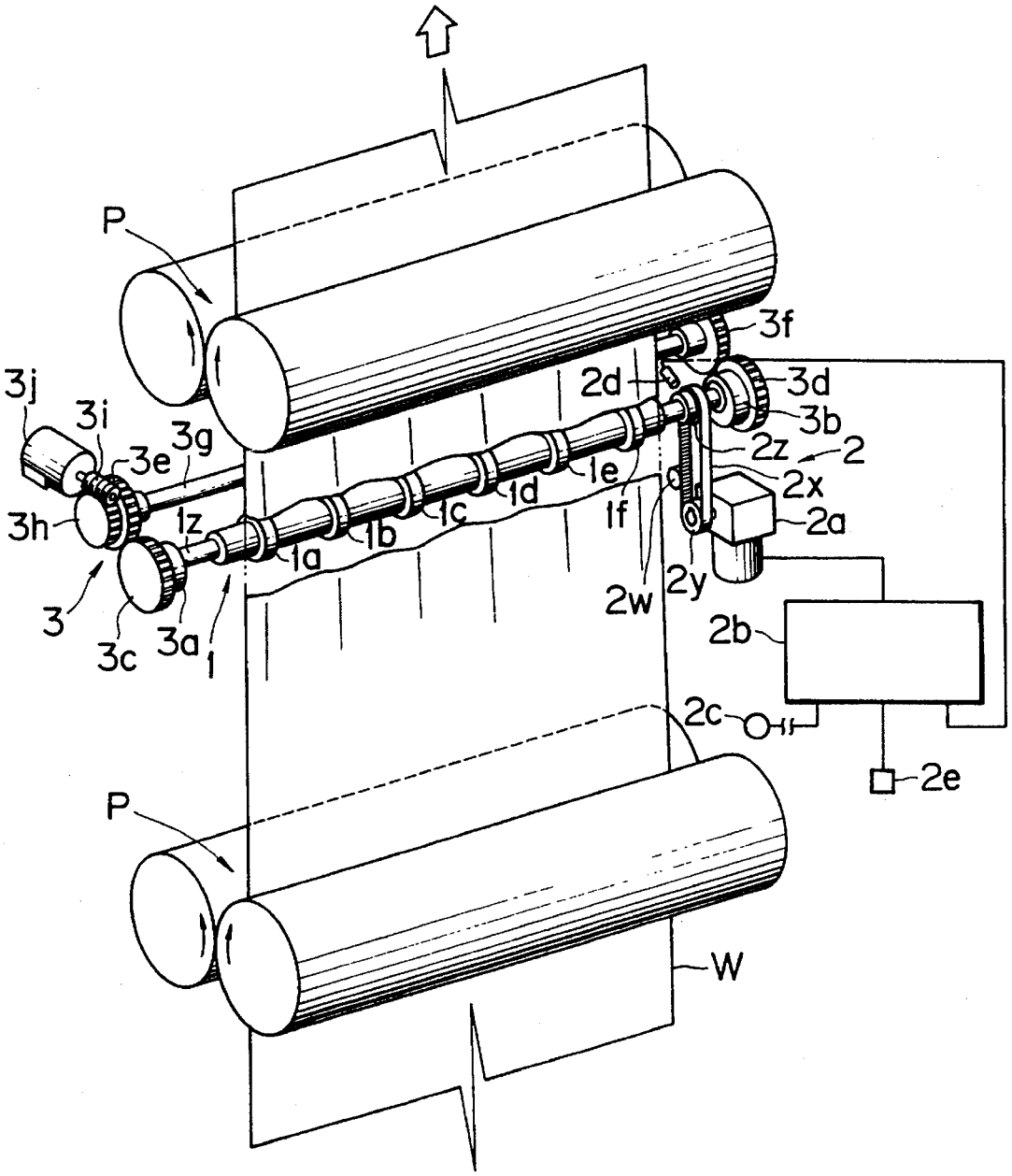
FIG. 1 is a schematically perspective view showing the first embodiment of a web width adjusting device according to the present invention, wherein contact members are arranged at the one side of the paper web and simultaneously rotated.

FIG. 1 shows the first embodiment of the width adjusting device according to the present invention. In FIG. 1, contact members 1*a*, 1*b*, 1*c*, 1*d*, 1*e* and 1*f* of the pressure applying means 1 are integrally formed on a shaft 1*z* so that they are simultaneously rotated by a single drive mechanism. One end of the shaft 1*z* is provided with a pulley 2*z* which is connected to an output pulley 2*y* through a drive belt 2*x*. The output pulley 2*y* is fixed to a drive unit 2*a* of a drive controlling means 2. The drive belt 2*x* is applied with proper tension by a tension roller 2*w*. The pressure applying means 1 is arranged adjacent to at least one of the upper and lower stream of a printing section P.

The drive control means 2 further comprises a control unit 2*b* in addition to the drive unit 2*a*. The control unit 2*b* controls the drive unit 2*a* so that the contact members 1*a* to 1*f* are moved in the different direction and/or at the different speed of the paper web W travelling. The control unit 2*b* is electrically connected to a first detector 2*c* for detecting the travelling speed of the paper web W, a second detector 2*d* for detecting actual moving speed of the contact members 1*a* to 1*f*, and a control parameter input unit 2*e* through which various parameters such as the moving direction and moving speed of the contact members 1*a* to 1*f*. In this embodiment, the first detector 2*c* actually detects the driving speed of the cylinders of the printing section P P because the travelling speed of the paper web W depends on the driving speed of the cylinders. Also the second detector 2*d* detects the rotating speed of the shaft 1*z* representing the moving speed of the contact members 1*a* to 1*f*.

In FIG. 1, a numeral 3 denotes a shift mechanism 3 for shifting the contact members la to if toward and apart from the web surface W so as to adjust the magnitude of the wave formed by the contact members 1*a* to 1*b*. The shift mechanism 3 includes eccentric sleeves 3*a* and 3*b* which rotatably support both ends of the shaft 1*z* eccentrically. Further, the eccentric sleeves 3*a* and 3*b* are respectively provided at their ends with end gears 3*c* and 3*b* which are integrally rotated with their connected eccentric sleeves 3*a* and 3*db*. An auxiliary shaft 3*g* is also extended in the lateral direction of the paper web W and arranged in parallel with the shaft 1*z*. The end gears 3*c* and 3*d* are meshingly engaged with end gears 3*e* and 3*f* fixed to the ends of the auxiliary shaft 3*e*, respectively. The end gear 3*e* is further provided with a worm wheel 3*h* which is integrally rotated with the end gear 3*e*. The worm wheel 3*h* is meshed with a worm 3*i* fixed to a shaft of a driving means 3*j*.

In the first embodiment shown in FIG. 1, as a start switch of this printing system is turned on, the paper web W is travelled through the printing sections P so that the paper web W is successively printed. On the same occasion, the drive unit 2*a* of the drive control means 2 is actuated in accordance with the output signal from the control unit 2*b*. The drive force generated by the drive unit 2*a* is transmitted to the shaft 1*z* through the output pulley 2*y*, the drive belt 2*x*, and the pulley 2*z*. According to this drive force, the contact members 1*a* to if integrally fixed to the shaft 1*z* are rotated. The control unit 2*b* currently compares the detected signals from the first detector 2*c* and the second detector 2*d* with the preset control parameter input from the control parameter input unit 2*e*, and outputs a control signal to the drive unit 2*a*. As a result, the contact members 1*a* to 1*f* of the pressure applying means 1 can be rotated in the counter direction and/or at the different speed of the paper web W. This will cause scraping function between the contact members 1*a* to 1*f* and the paper web W so that the paper dusts and ink can be removed from the contact members 1*a* to 1*f* by the paper web W.

If the control unit 2*b* can always control that the drive unit 2*a* is kept at a lower or higher speed than the travelling speed of the paper web W; i.e., the contact members 1*a* to if are always rotated at a lower or higher speed than the travelling speed of the web W, the first and second detectors 2*c* and 2*d*, and the control parameter input unit 2*e* will be omitted.

Alternatively, if the drive unit 2*a* is linked with the drive mechanism of the printing apparatus through any transmission such as a torque convertor, stepless speed change device, and the like, not shown, the control unit 2*b* will be also unnecessary in addition to the first and second detectors 2*c* and 2*d*, and the input unit 2*e*.

In the shift mechanism 3, the driving force is generated by the driving means 3*j* and transmitted to the eccentric sleeves 3*a* and 3*b* through the worm 3*i*, the worm wheel 3*h*, the auxiliary shaft 3*g*, and the end gears 3*e*, 3*f*, 3*c*, 3*d*. Since the shaft 1*z* is eccentrically supported by the eccentric sleeves 3*a* and 3*b*, the contact members 1*a* to if is shifted toward and apart from the web surface. The driving means 3*j* is manually or automatically controlled in accordance with the printed condition.

Figure 2:
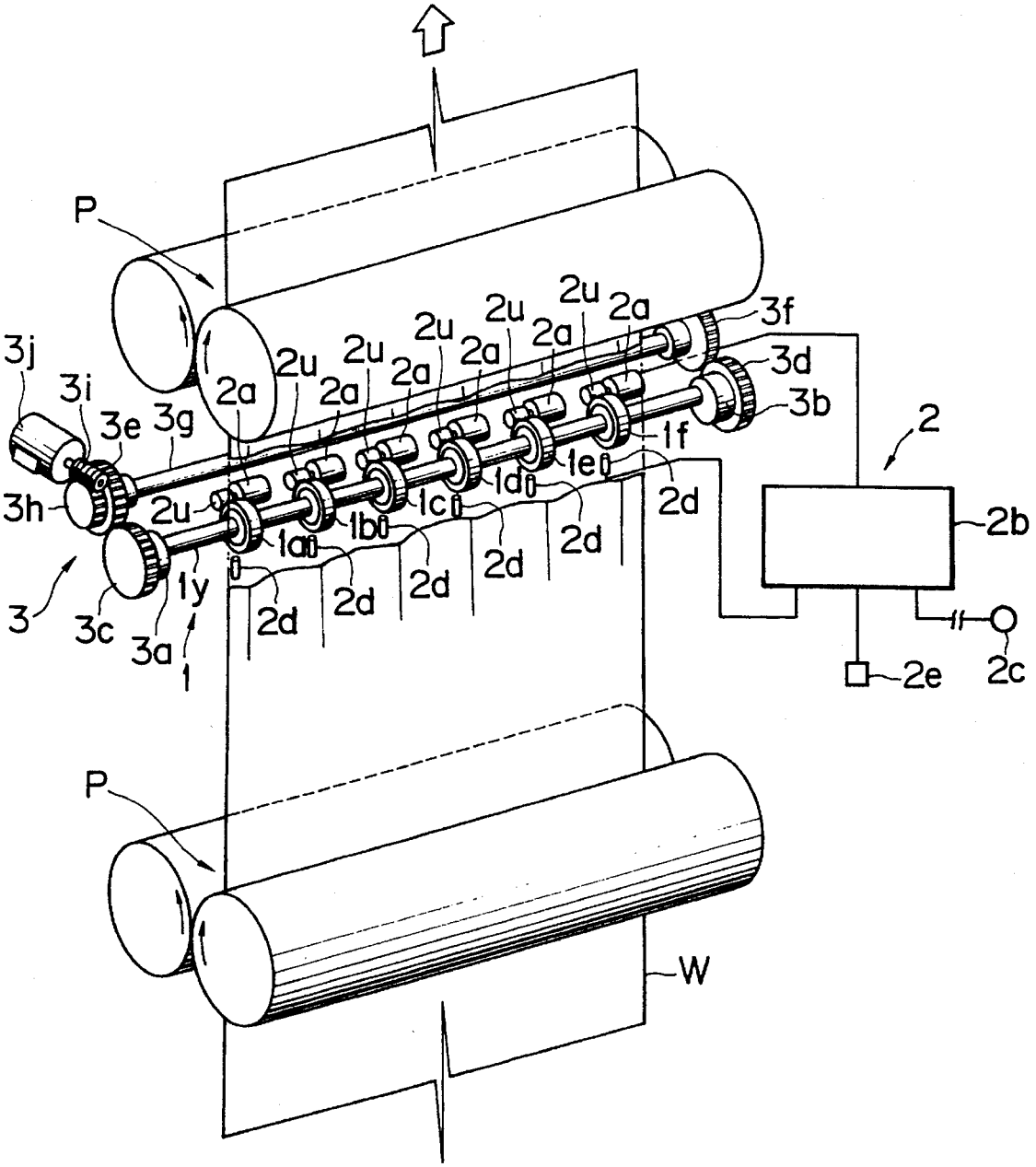
FIG. 2 is a schematically perspective view showing the second embodiment of a web width adjusting device according to the present invention, wherein contact members are arranged at the one side of the paper web and respectively rotated by corresponding drive units.

FIG. 2 shows the second embodiment of the width adjusting device according to present invention. In this second embodiment, a pressure applying means 1 includes a shaft 1*y* provided with a plurality of contact members 1*a*, 1*b*, 1*c*, 1*d*, 1*e* and 1*f* which are individually rotated. Each of the contact members is associated with a driving roller 2*u* of a drive unit 2*a* so that driving force is directly transmitted to the contact members.

The drive units 2*a* are respectively fixed to the shaft 1*y* by means of brackets, not shown so that the driving rollers 2*u* of the drive units 2*a* are always in contact with the contact members 1*a* to if while the contact members 1*a* to if are shifted toward or apart from the web W.

A drive control means 2 in the second embodiment also comprises a control unit 2*b* in addition to the drive units 2*a*. The control unit 2*b* controls the drive unit 2*a* so that the contact members 1*a* to 1*f* are moved in the different direction and/or at the different speed of the paper web W travelling. The control unit 2*b* is electrically connected to a first detector 2*c* for detecting the travelling speed of the paper web W, a plurality of second detectors 2*d* for respectively detecting actual moving speed of the contact members 1*a* to 1*f*, and a control parameter input unit 2*e* through which various parameters such as the moving direction and moving speed of the contact members 1*a* to 1*f*. In this embodiment, the first detector 2*c* actually detects the driving speed of the cylinders of the printing section P because the travelling speed of the paper web W depends on the driving speed of the cylinders.

In the second embodiment, a shift mechanism 3 is also arranged to shift the contact members 1*a* to 1*f* of the pressure applying means 1 toward or apart from one side surface of the paper web W so that the degree of wave formed in the web surface is varied. This shift mechanism 3 of the second embodiment is substantially similar to that of the first embodiment shown in FIG. 1 except that the shaft 1*y* is eccentrically and stationarily supported by eccentric sleeves 3*a* and 3*b*.

FIG. 2 shows only a part of connection means between the control unit 2*b* and the drive units 2*a*, and between the control unit 2*b* and the second detector 2*d* in order to simply understand.

A typical operation of the second embodiment is essentially similar to the first embodiment except that the contact members 1*a* to 1*f* are individually rotated by the associated drive units 2*a* through the driving rollers 2*u*.

Figure 3:
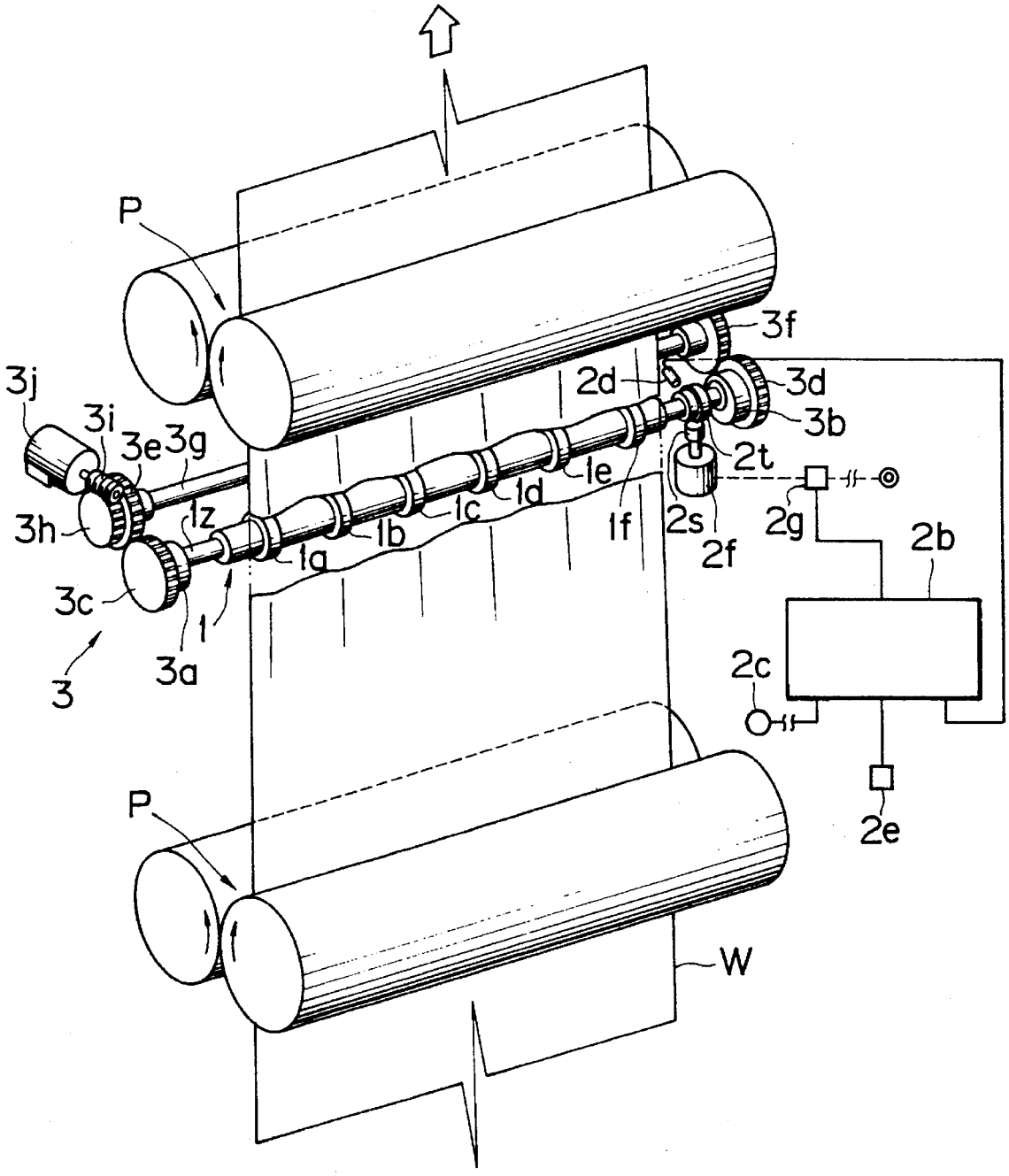
FIG. 3 is a schematically perspective view showing the third embodiment of a web width adjusting device according to the present invention, wherein contact members are arranged at the one side of the paper web and. simultaneously rotated.

FIG. 3 shows the third embodiment of the width adjusting device according to the present invention which is a modification of the first embodiment shown in the FIG. 1. That is, the pulley 2*z* fixed to the shaft 1*z* and the drive unit 2*a* of the drive control means 2 in the first embodiment are respectively replaced by a friction roller 2*t* and a brake means 2*f* associated with a regulator 2*g*. The friction roller 2*t* is in contact with a brake member 2*s* fixed to the brake means 2*f* so that the pressure applying means 1 can be rotated at the different speed from the travelling paper web W. The third embodiment is configured in the same as the first embodiment except for the above drive control mechanism.

In the third embodiment, the paper web W is travelled through the printing sections P in the same manner as the first embodiment. The contact members 1*a* to 1*f* are forcibly rotated owing to the friction generated between the contact members and the travelling paper web W. The control unit 2*b* compares the information signals from the first and second detectors 2*c* and 2*d* with the preset control parameters input from the control parameter input unit 2*e*, and outputs a control signal to the regulator 2*g*. Finally, the brake means 2*f* is controlled by the regulator 2*g* to change the pressure of the brake member 2*s* against the friction roller 2*t*. According to this drive control mechanism, the contact members 1*a* to 1*f* are rotated at the different speed from the paper web W. The difference in moving speed between the paper web W and the contact members 1*a* to 1*f* generates friction between their contact surfaces which can remove the paper dusts and ink from the limited places. This embodiment does not includes means for changing the moving direction of the contact members 1*a* to 1*f*.

The control unit 2*b* may periodically generate and output a control signal to alternately move and stop the contact members 1*a* to 1*f*. When this system is employed, the regulator 2*g*, the first and second detectors 2*c* and 2*d*, and the control parameter input unit 2*e* will be omitted.

The shift mechanism 3 of this embodiment will be carried out in the same manner as FIG. 1.

Figure 4:
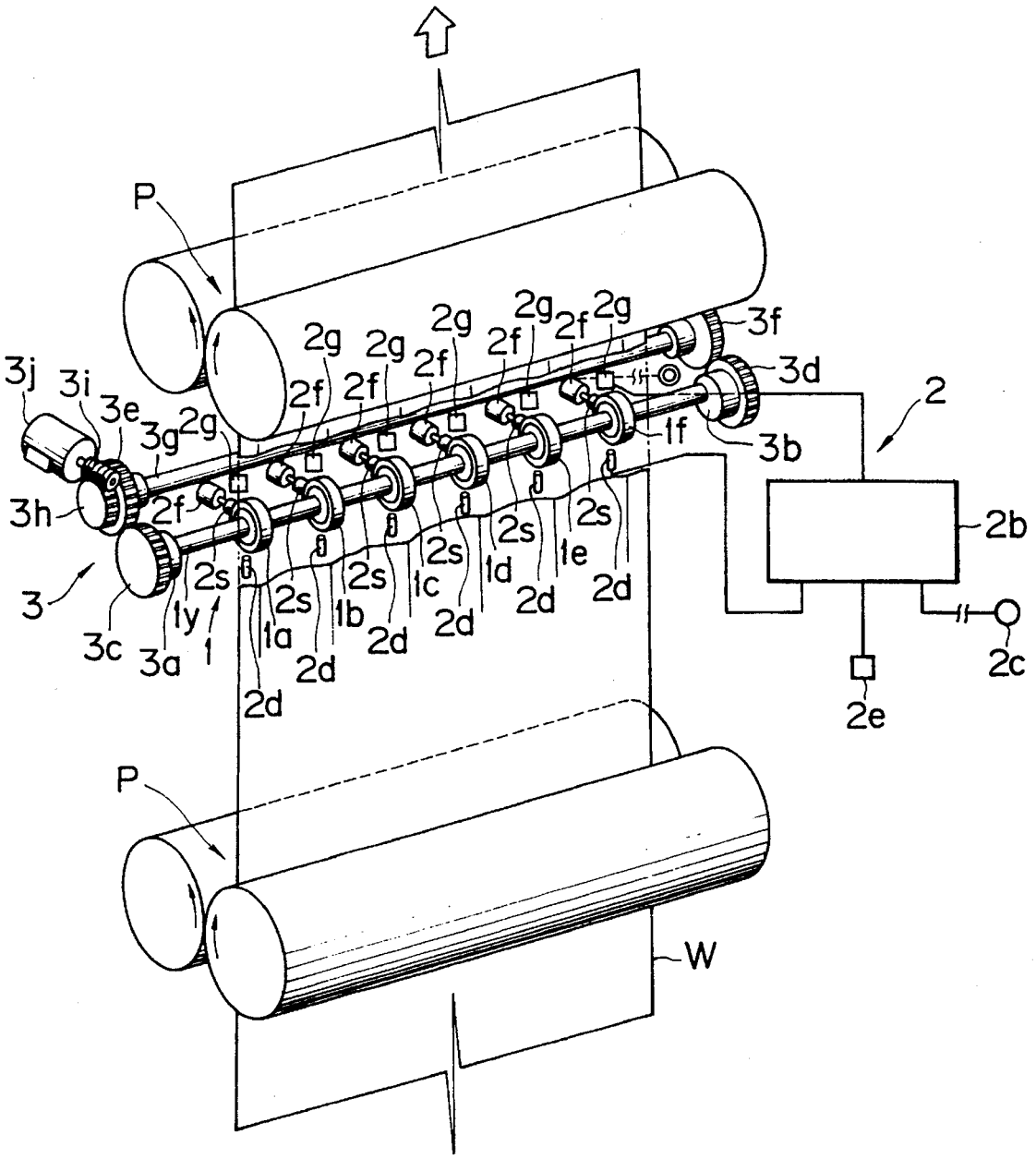
FIG. 4 is a schematically perspective view showing the fourth embodiment of a web width adjusting device according to the present invention, wherein contact members are arranged at the one side of the paper web and respectively rotated by corresponding drive units.

FIG. 4 shows the fourth embodiment of the width adjusting device according to the present invention which is a modification of the second embodiment shown in FIG. 2. That is, the drive units 2*a* arranged along the shaft 1*y* in the second embodiment are respectively replaced by brake means 2*f* each of which is associated with a regulator 2*g*. Brake members 2*s* of the brake means 2*f* are respectively in contact with the contact members 1*a* to 1*f* so that the pressure applying means 1 can be rotated at the different speed from the travelling paper web W. The fourth embodiment is configured in the same as the second embodiment as shown in FIG. 2 except for the above drive control mechanism.

FIG. 4 shows only a part of connection means between the control unit 2*b* and the brake means 2*f* via the regulator 2*g*, and between the control unit 2*b* and the second detectors 2*d* in order to simply understand.

The brake means 2*f* of the fourth embodiment are controlled in the same manner as the third embodiment shown in FIG. 3 to make the rotating speed of the contact members 1*a* to 1*f* lower than the travelling speed of the paper web W. In detail, the control unit 2*b* compares the information signals from the first and second detectors 2*c* and 2*d* with the preset control parameters input from the control parameter input unit 2*e*, and outputs a control signal to the regulators 2*g*. Finally, the brake means 2*f* are controlled by the regulators 2*g* to change the pressure, of the brake members 2*s* against the contact members 1*a* to 1*f*. According to this brake pressure, the rotating speed of the contact members 1*a* to 1*f* area lowered than the travelling speed of the paper web W. The functions caused between the contact members 1*a* to 1*f* and the paper web W are essentially similar to the third embodiment.

Figure 5:
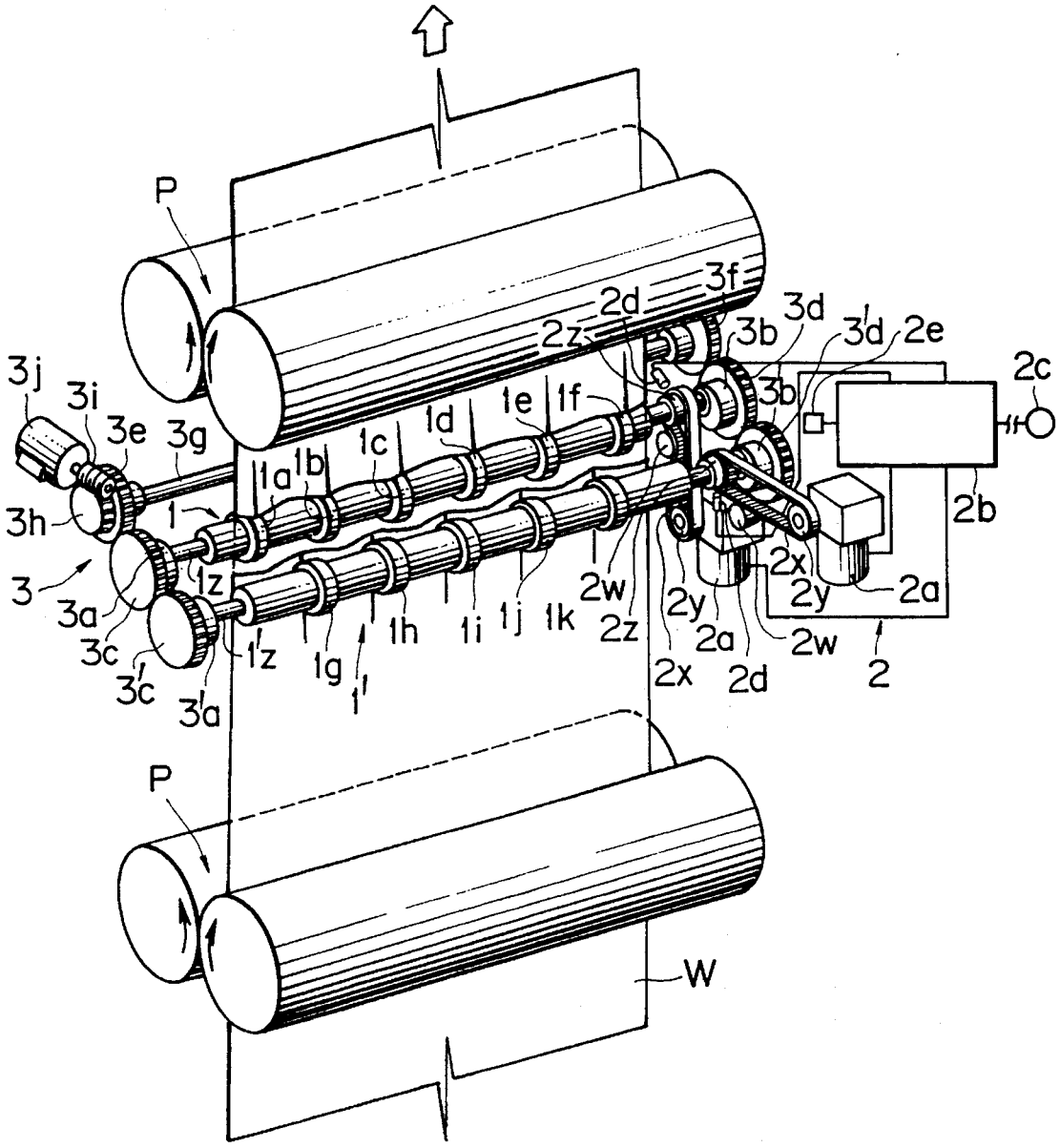
FIG. 5 is a schematically perspective view showing the fifth embodiment of a web width adjusting device according to the present invention, wherein contact members are arranged at both sides of the paper web and simultaneously rotated.

FIG. 5 shows the fifth embodiment of the width adjusting device according to the present invention which is a modification of the first embodiment shown in FIG. 1. That is, fifth embodiment further includes another pressure applying means 1' (referred to second pressure applying means) at the other side of the paper web W in addition to the first embodiment. The second pressure applying means 1' comprises a plurality of contact members 1*g* to 1*k* which are arranged in a particular interval distance in the lateral direction of the paper web W to be shifted with respect to the contact members 1*a* to 1*f*. The contact members 1*g* to 1*k* are also fixed to a rotatable shaft 1'*z* so that they can be rotated all together. The rotatable shaft 1'*z* is also mechanically connected to another drive control mechanism. In detail, one end of the rotatable shaft 1'*z* is provided with a pulley 2*z* which is connected to an output pulley 2*y* through a drive belt 2*x*. The output pulley 2*y* is fixed to a drive unit 2*a* of a drive controlling means 2. The drive belt 2*x* is applied with proper tension by a tension roller 2*w*.

Both ends of the rotatable shaft 1'*z* are rotatably and eccentrically supported by eccentric sleeves 3'*a* and 3'*b* of a shift mechanism 3. The eccentric sleeves 3'*a* and 3'*b* are respectively provided at their ends with end gears 3'*c* and 3'*d* which are integrally rotated with their connected eccentric sleeves 3'*a* and 3'*b*. Further the end gears 3'*c* and 3'*d* are respectively meshed with end gears 3*c* and 3*d* of the first shift mechanism 3. The fifth embodiment is configured in the same as the first embodiment except for the second pressure applying means 1' and associated mechanism as described above.

In the fifth embodiment, as a start switch of this printing system is turned on, the drive units 2*a* of the drive control means 2 are actuated in accordance with an output signal from a control unit 2*b* to independently rotate the pressure applying means 1 and 1'. On the same occasion, the shift mechanism 3 is also actuated and the driving force is generated by the driving means 3*j* and transmitted to the eccentric sleeves 3*a* and 3*b* through the worm 3*i*, the worm wheel 3*h*, the auxiliary shaft 3*g*, and the end gears 3*e*, 3*f*, 3*c*, 3*d*, and to eccentric sleeves 3'*a* and 3'*b* through the end gears 3'*c* and 3'*d* meshed with the end gears 3*c* and 3*d*, respectively. Since the shafts 1*z* and 1'*z* are eccentrically supported by the eccentric sleeves 3*a* and 3*b*, and 3'*a* and 3'*b*, the contact members 1*a* to 1*f* of the first pressure applying means 1 and the contact members 1*g* to 1*k* of the second pressure applying means 1' are shifted toward and apart from the web surface. Further operation will be carried out in the similar manner as the first embodiment shown in FIG. 1.

Figure 6:
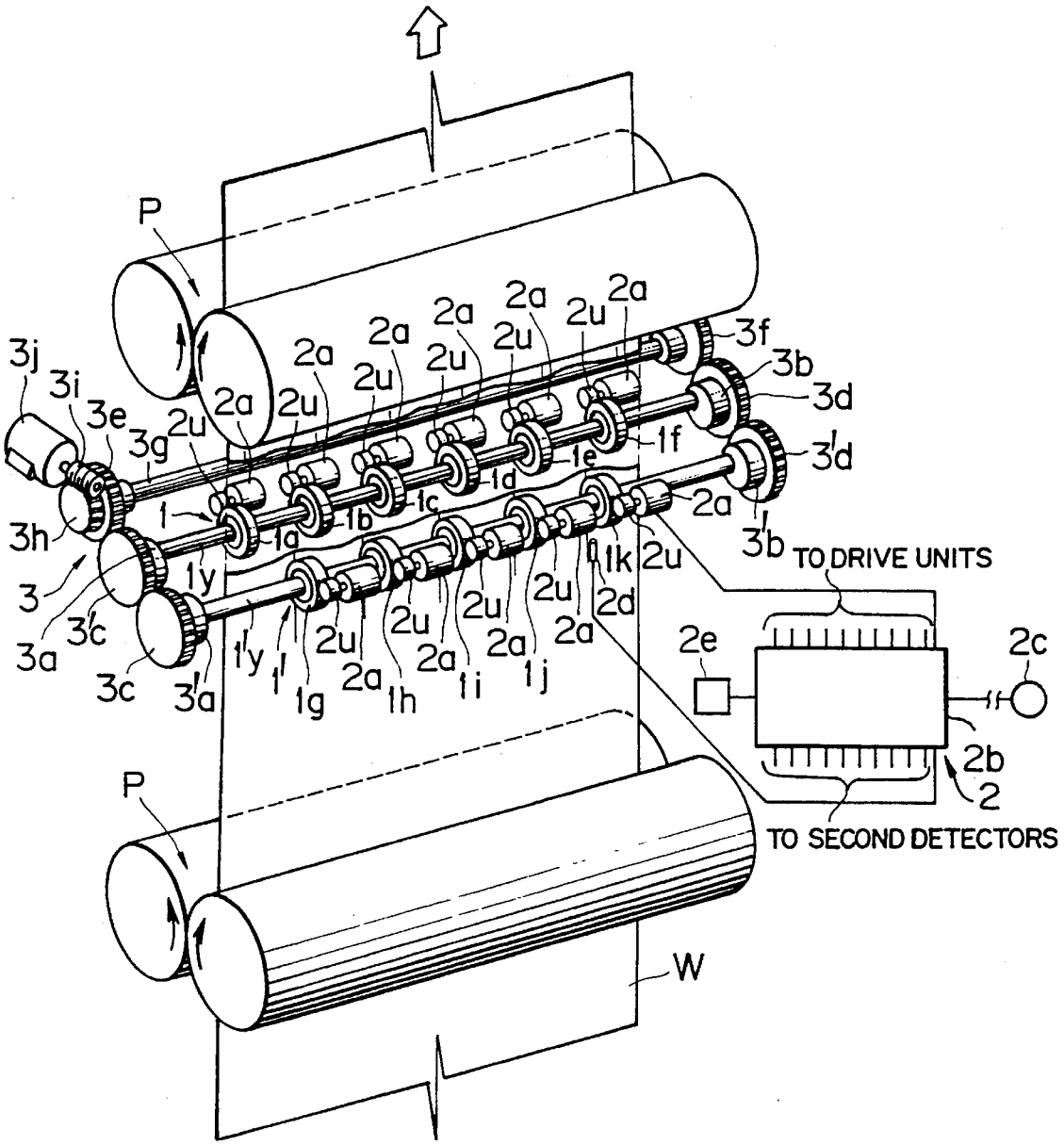
FIG. 6 is a schematically perspective view showing the sixth embodiment of a web width adjusting device according to the present invention, wherein contact members are arranged at both sides of the paper web and respectively rotated by corresponding drive units.

FIG. 6 shows the sixth embodiment of the width adjusting device according to the present invention which is a modification of the second embodiment shown in FIG. 2. That is, the sixth embodiment further includes another pressure applying means 1' (referred to second pressure applying means) at the other side of the paper web W in addition to the second embodiment. The second pressure applying means 1' comprises a plurality of contact members 1*g* to 1*k* which are arranged at a particular interval distance in the lateral direction of the paper web W to be shifted with respect to the contact members 1*a* to 1*f*. Each of the contact members 1*g* to 1*k* is rotatably assembled on a shaft 1'*y* and associated with a driving roller 2*u* of a drive unit 2*a* so that driving force is directly transmitted to the contact members.

The drive units 2*a* are respectively fixed to the shaft 1'*y* by means of brackets, not shown, so that the driving rollers 2*u* of the drive units 2*a* are always in contact with the contact members 1*g* to 1*k* while the contact members 1*g* to 1*k* are shifted toward or apart from the web W.

The shaft 1'*y* is stationarily and eccentrically supported at both ends by eccentric sleeves 3'*a* and 3'*b* of a shift mechanism 3. The eccentric sleeves 3'*a* and 3'*b* are respectively fixed with end gears 3'*c* and 3'*d* which are meshed with the end gears 3*c* and 3*d* of the first pressure applying means 1. The other structure is similar to that of FIG. 2.

FIG. 6 does not show a second detector 2*d*, a connection system between a control unit 2*b* and the drive units 2*a*, and a connection system between the control unit 2*b* and the second detector 2*d* for the sake of easily understanding.

In the sixth embodiment, the drive units 2*a* are actuated in response to the control signal from the control unit 2*b* to generate driving force so that the contact members 1*g* to 1*k* of the second pressure applying means 1' are independently rotated by the driving force transmitted from the drive units 2*a* through the driving rollers 2*u*.

The shaft 1'*y* of the second pressure applying means 1' is shifted by the shift mechanism in the same manner as the fifth embodiment. Further operation will be carried out in the same manner as the second embodiment shown in FIG. 2.

Figure 7:
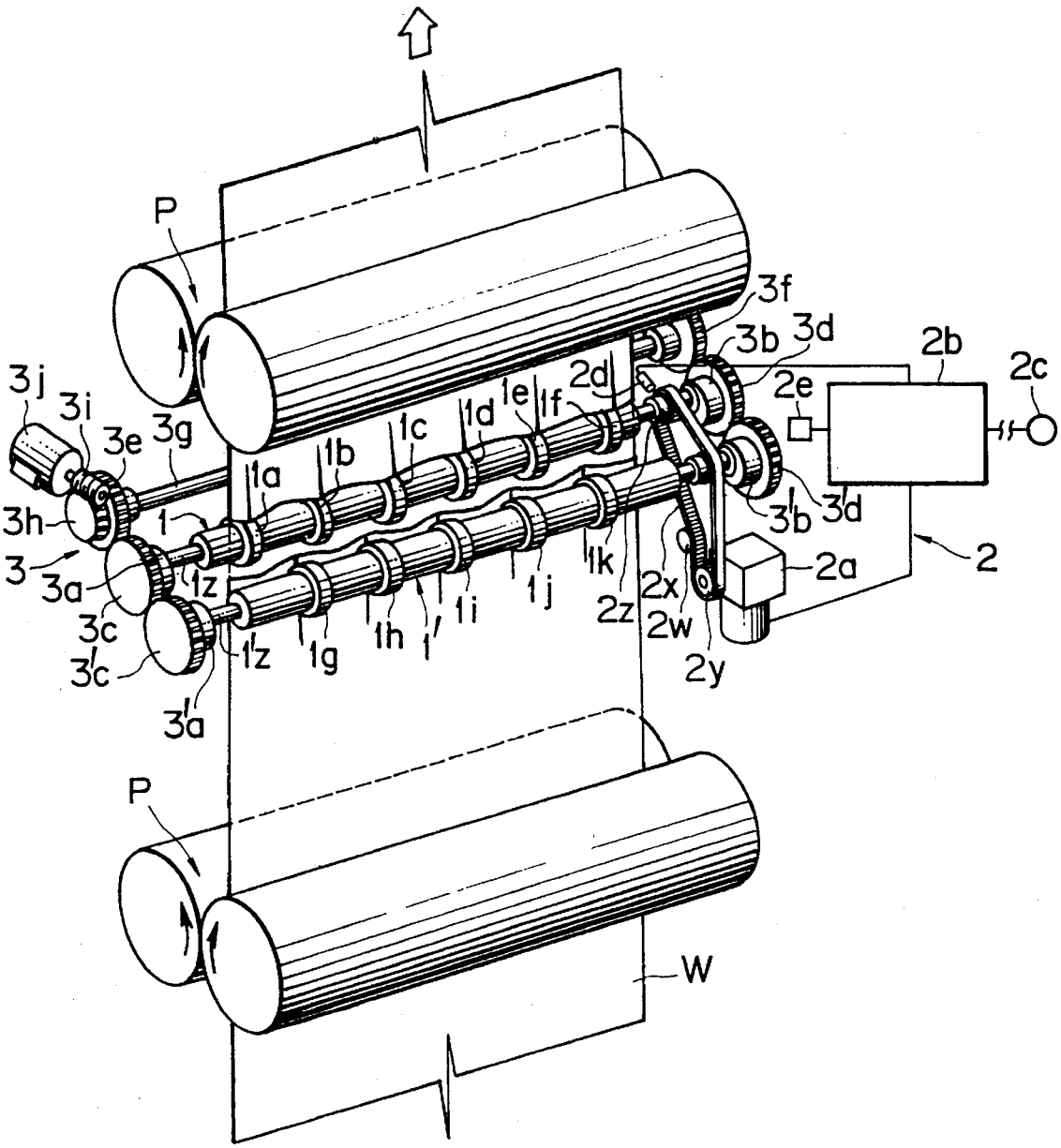
FIG. 7 is a schematically perspective view showing the seventh embodiment of a web width adjusting device according to the present invention, wherein contact members are arraged at both sides of the paper web and simultaneously rotated.

FIG. 7 shows the seventh embodiment of the width adjusting device according to the present invention which is a modification of the fifth embodiment shown in FIG. 5. That is, this configuration employs a single drive unit 2*a* of a drive control means 2 and a single drive belt 2*x* for connecting among two pulleys 2*z*, 2*z* and an output pulley 2*y* of the drive unit 2*a*. The other parts and configurations are similar to the fifth embodiment shown in FIG. 5.

In the seventh embodiment shown in FIG. 7, the drive unit 2*a* is actuated in response to the control signal from a control unit 2*b* to generate driving force so that contact members 1*a* to 1*f* and 1*g* to 1*k* of the first and second pressure applying means 1 and 1' are simultaneously rotated in the same direction. Further operation will be carried out in the same manner as the fifth embodiment shown in FIG. 5.

According to this configuration, since the contact members 1*a* to 1*f* and 1*g* to 1*k* are rotated in the same direction, either is reversely moved with respect to the travelling direction of the paper web W.

Figure 8:
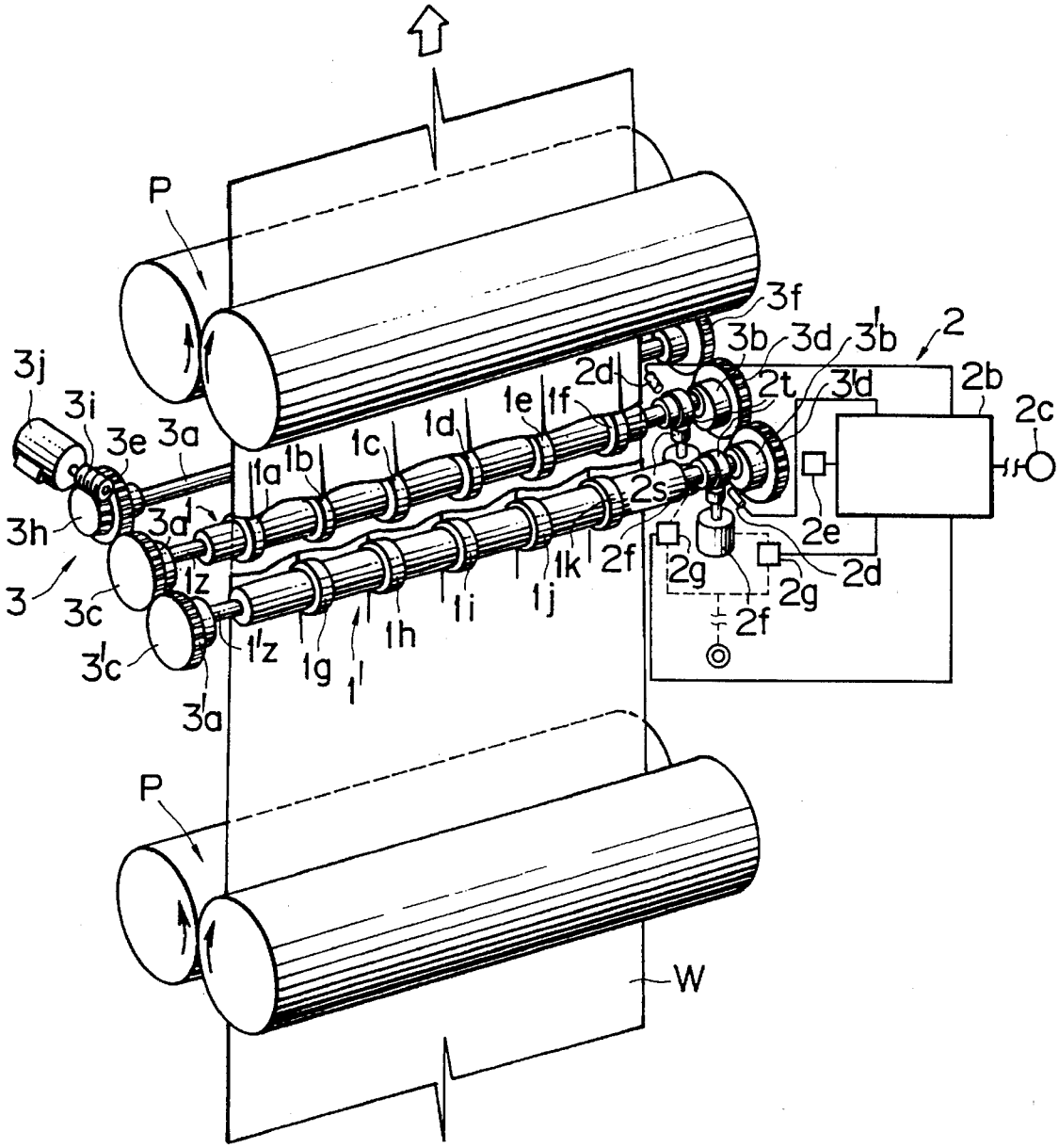
FIG. 8 is a schematically perspective view showing the eighth embodiment of a web width adjusting device according to the present invention, wherein contact members are arranged at both sides of the paper web and simultaneously rotated.

FIG. 8 shows the eighth embodiment of the width adjusting device according to the present invention which is a modification of the fifth embodiment shown in FIG. 5. In detail, the pulleys 2*z* fixed to the shafts 1*z* and 1'*z* are replaced by friction rollers 2*t*; and the drive units 2*a* are also replaced by brake means 2*f* provided with regulators 2*g*. The friction rollers 2*t* are in contact with brake members 2*s* of the brake means 2*f* so that the contact members 1*a* to 1*f* and 1*g* to 1*k* of the first and second pressure applying means 1 and 1' are rotated at the different speed from the travelling speed of the paper web W. The other parts are similarly configured as the fifth embodiment shown in FIG. 5.

In this embodiment, the contact members 1*a* to 1*f*, 1*g* to 1*k* of the first and second pressure applying means 1 and 1' are forcibly rotated owing to the friction generated between the contact members and the travelling paper web W. The control unit 2*b* compares the information signals from the first and second detectors 2*c* and 2*d* with the preset control parameters input from the control parameter input unit 2*e*, and outputs a control signal to the regulators 2*g*. Finally, the brake means 2*f* are controlled by the regulators 2*g* to change the pressure of the brake members 2*s* against the friction rollers 2*t*. According to this drive control mechanism, the contact members 1*a* to 1*f*, and 1*g* to 1*k* are rotated at the different speed from the paper web W. This embodiment does not includes means for changing the moving direction of the contact members 1*a* to 1*f*, and 1*g* to 1*k*.

The control unit 2*b* may periodically generate and out put a control signal to alternately move and stop the contact members 1*a* to 1*f*, 1*g* to 1*k*. When this system is employed, the regulators 2*g*, the first and second detectors 2*c* and 2*d*, and the control parameter input unit 2*e* will be omitted.

The shift mechanism 3 of this embodiment will be carried out in the same manner as FIG. 5.

Figure 9:
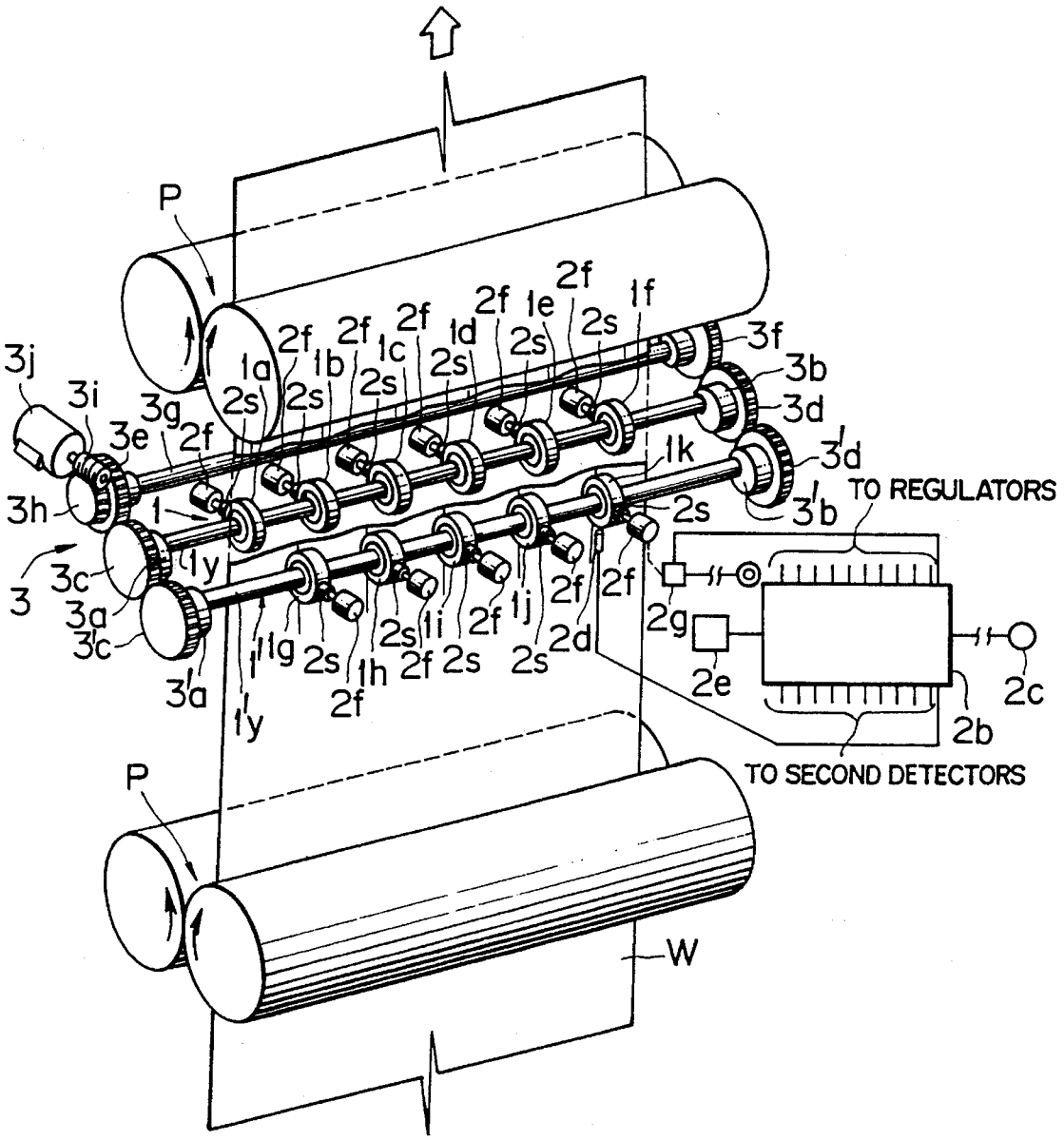
FIG. 9 is a schematically perspective view showing the nineth embodiment of a web width adjusting device according to the present invention, wherein contact members are arranged at both sides of the paper web and respectively rotated by corresponding drive units.
Figure 10:
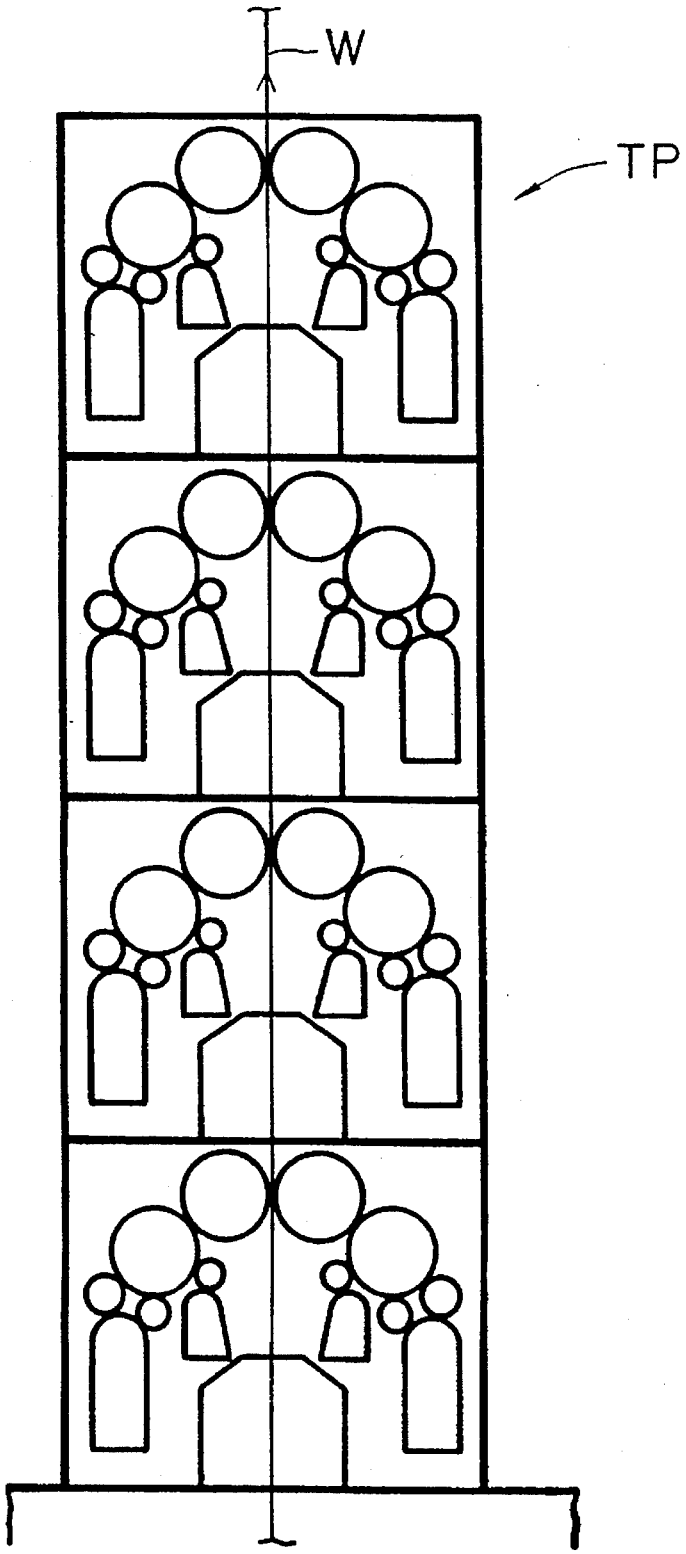
FIG. 10 is a schematisc illustration showing an overall construction of a rotary lithographic press including a plurality of printing sections each of which is associated with a web width adjusting device according to the present invention.

FIG. 9 shows the nineth embodiment of the width adjusting device according to the present invention which is a modification of the sixth embodiment shown in FIG. 6. In detail, the drive units 2*a* arranged along the shaft 1*y* in the sixth embodiment are respectively replaced by brake means 2*f* each of which is associated with a regulator 2*g*. Brake members 2*s* of the brake means 2*f* are respectively in contact with the contact members 1*a* to 1*f*, and 1*g* to 1*k* of the first and second pressure applying means 1 and 1' so that the pressure applying means 1 and 1' can be rotated at the different speed from the travelling paper web W. The nineth embodiment is configured in the same as the sixth embodiment as shown in FIG. 6 except for the above drive control mechanism.

FIG. 9 does not wholly show the connection systems between a control unit 2*b* and the brake means 2*f* through the regulators 2*g*, and between the control unit 2*b* and the second detectors 2*d* for the sake of easily understanding.

The brake means 2*f* of the nineth embodiment are controlled in the same manner as the eighth embodiment shown in FIG. 8 to make the rotating speed of the contact members 1*a* to 1*f*, and 1*g* to 1*k* of the first and second pressure applying means 1 and 1' lower than the travelling speed of the paper web W. In detail, the control unit 2*b* compares the information signals from the first and second detectors 2*c* and 2*d* with the preset control parameters input from the control parameter input unit 2*e*, and outputs a control signal to the regulators 2*g*. Finally, the brake means 2*f* are controlled by the regulators 2*g* to change the pressure of the brake members 2*s* against the contact members 1*a* to 1*f*, and 1*g* to 1*k*. According to this brake pressure, the rotating speed of the contact members are lowered than the travelling speed of the paper web W. The cleaning functions caused between the contact members and the paper web W are essentially similar to the former embodiments.

As disclosed above, the contact position between the pressure force applying means and the paper web is periodically or randomly varied by the drive control means and/or the drive-speed of the pressure force applying means is forcibly varied with respect to the travelling speed of the paper web. This drive control means prevents the contact position between the pressure force applying means and the paper web from storing with paper dusts and ink. Thus the printed image can be kept clear without any spoilages owing to the paper dusts and ink stored.

The present invention is not only limited to the above described embodiments, but many modifications and variations may be also contained in the spirit of the present invention without departing from the scope of the invention as hereinafter claimed.

What is claimed is:

1. A printing apparatus comprising:

a plurality of vertically arranged printing sections for printing a paper web; and a web width adjusting device comprising at least one means for applying a pressure force with respect to at least one side surface of said paper web in order to decrease the width of the web; and at least one drive control means for making said pressure force applying means move in a different direction and at a different speed from a corresponding direction and speed at which the paper web is travelling for making said paper web clean parts of said pressure force applying means by preventing an accumulation of paper dust;

wherein said control means includes means for varying the moving speed of said pressure force applying means.

2. The printing apparatus as set forth in claim 1, wherein said pressure force applying means includes a plurality of contact members which are arranged at a regular interval in a lateral direction of the paper web.

3. The printing apparatus as set forth in claim 2, wherein said contact members are integrally controlled by said drive control means.

4. The printing apparatus as set forth in claim 3, wherein said drive control means includes a driving means for changing the moving direction of said contact members.

5. The printing apparatus as set forth in claim 3, wherein said drive control means includes a braking means for lowering a moving speed of said contract members below a travelling speed of the paper web.

6. The printing apparatus as set forth in claim 2, wherein said contact members are independently controlled by said drive control means.

7. The printing apparatus as set forth in claim 6, wherein said drive control means includes a driving means for changing the moving direction of said contact members.

8. The printing apparatus as set forth in claim 6, wherein said drive control means includes a braking means for lowering a moving speed of said contact members below a travelling speed of the paper web.

9. The printing apparatus as set forth in claim 1, wherein said at least one drive control means comprises a drive unit operatively connected via a drive belt to said pressure force applying means.

* * * * *